United States Patent [19]

Szpur

[11] 4,290,096

[45] Sep. 15, 1981

[54] LIGHT FIXTURE

[76] Inventor: Roman Szpur, 2685 Culver Ave., Dayton, Ohio 45429

[21] Appl. No.: 84,554

[22] Filed: Oct. 15, 1979

[51] Int. Cl.[3] ..... F71S 3/00

[52] U.S. Cl. ..... 362/223; 362/263; 362/267; 362/276; 362/307

[58] Field of Search ..... 362/223, 263, 267, 276, 362/307

[56] References Cited

U.S. PATENT DOCUMENTS

| | | | |
|---|---|---|---|
| 1,899,272 | 2/1933 | Hertz | 362/349 |
| 4,112,485 | 9/1978 | Sutter | 362/390 |

*Primary Examiner*—Stephen J. Lechert, Jr.
*Attorney, Agent, or Firm*—Jacox & Meckstroth

[57] ABSTRACT

A rectangular reflector sheet of relatively stiff aluminum is curved into the general shape of an elongated parabola and is inserted into a cylindrical transparent glass tube so that the edge portions of the sheet press outwardly against the tube. A set of end closure caps or members are clamped against the ends of the tube by a set of tie bolts which extend axially between the reflector sheet and the inner surface of the tube or outboard of the tube. Each of the end closure members is provided with an annular groove which confines a resilient gasket material to form a fluid-tight seal between the tube and the closure member. One of the end closure members has an eccentrically located hollow hub portion which supports a socket for receiving the socket end of an elongated lamp element extending along the offset focal axis of the curved reflector sheet. The other end closure member has a similar eccentric hub portion which supports a member for conducting heat from the lamp element as well as for supporting the opposite end of the lamp element. Each of the hub portions is closed by an end plug member which cooperates with the hub portion to define an annular L-shaped gap effective to release pressure within the tube and extinguish any flame in the event an environmental gas explodes within the tube.

11 Claims, 6 Drawing Figures

LIGHT FIXTURE

BACKGROUND OF THE INVENTION

In the use of a commercial or industrial light fixture, for example, of the type disclosed in U.S. Pat. Nos. 4,021,660 and 4,138,713 which issued to the assignee of the present invention, it is sometimes desirable for the fixture to be used in an environment where the air contains a gas or fumes or particles which will easily ignite. For example, the light fixture may be used in a coal mine or a petroleum refinery, or granary or chemical plant where it is highly desirable to prevent an accidental explosion within the light fixture from escaping and igniting the gas or particles within the surrounding environment. Thus it is necessary for the light fixture to provide some means for releasing an explosive gas within the light fixture to prevent cracking of the glass lens and also to extinguish any flame which develops within the fixture and attempts to escape with the pressurized gas.

SUMMARY OF THE INVENTION

The present invention is directed to an improved electrical light fixture which is ideally suited for use in an environment where the fixture is exposed to flammable gases and/or particles, and which is also simple and inexpensive in construction in addition to having substantial rigidity and durability. In accordance with the illustrated embodiment, the above desirable features and advantages are provided, in general, by a light fixture which includes an elongated cylindrical tube of high strength glass. A flat rectangular reflector sheet of relatively stiff metal is curved into the general shape of a parabola, and is inserted into the tube so that the opposite edge portions and an intermediate center portion of the sheet are urged outwardly against the inner surface of the tube. A set of end caps or closure members are mounted on and sealed to opposite end portions of the glass tube, and the closure members are clamped against the ends of the tube by a set of axially extending tie rods.

The closure members have corresponding eccentrically located and outwardly projecting hollow hub portions. One of the hub portions receives a socket for supporting the threaded end of an electric lamp element, and the hub portion of the other end closure member supports a spring biased member which engages the opposite end of the lamp element for conducting heat from the lamp element and for aiding in its support. Each of the hub portions is closed by a shouldered plug member which is spaced to define a precise annular gap having an L-shaped cross-sectional configuration.

Other features and advantages of the invention will be apparatus from the following description, the accompanying drawings and the appended claims.

DESCRIPTION OF THE PREFERRED EMBODIMENTS

Figure 1:
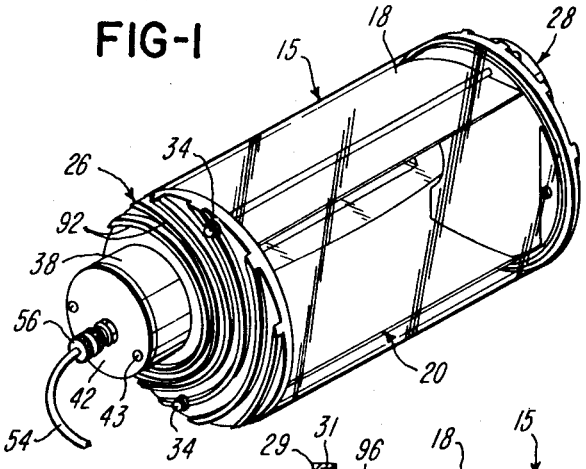
FIG. 1 is a perspective view of an electric light fixture constructed as shown in above-mentioned U.S. Pat. No. 4,021,660.
Figure 3:
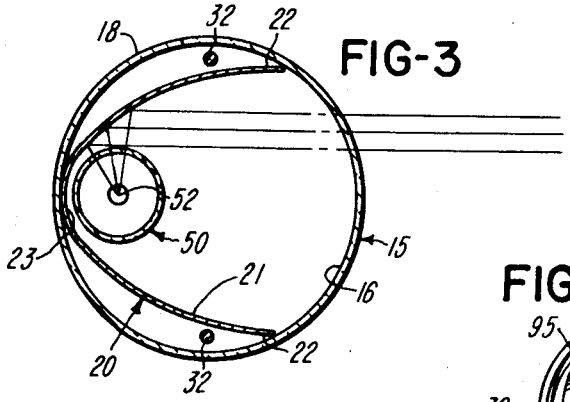
FIG. 3 is a radial section taken generally on the line 3—3 of FIG. 2.
Figure 4:
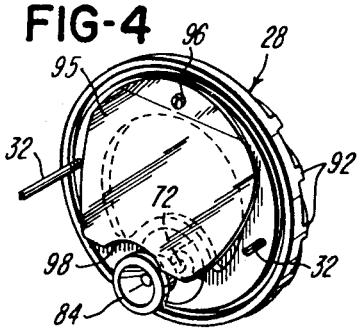
FIG. 4 is a perspective view of the removed end closure member shown in FIG. 2.

The light fixture illustrated in FIG. 1 includes an elongated cylindrical tube 15 of high strength or tempered transparent glass and which has a smooth cylindrical inner surface 16 and a smooth cylindrical outer surface 18. A reflector member or sheet 20 consists of a rectangular panel or sheet of aluminum having a highly polished reflective surface 21. Prior to being inserted into the tube 15, the relatively stiff reflector panel or sheet 20 is stored as a flat sheet. When a light fixture is assembled, the sheet is trimmed to a predetermined length according to the angle of light projection and the desired area of illumination. The reflector sheet is then manually bent or curved into a generally parabolic configuration (FIG. 3) and is inserted into the tube 15 so that the opposite edge or end portions 22 and an intermediate center portion 23 of the sheet are urged outwardly against the inner surface 16 of the tube 15 due to the inherent spring characteristic of the relatively stiff aluminum reflector sheet 20. This spring characteristic assures that the reflector sheet 20 remains in position, as illustrated in FIG. 3, but permits the edge portions 22 of the sheet to shift slightly relative to the inner surface 16 of the tube 15 in response to thermal expansion and contraction of the reflector sheet as its temperature changes.

Figure 2:
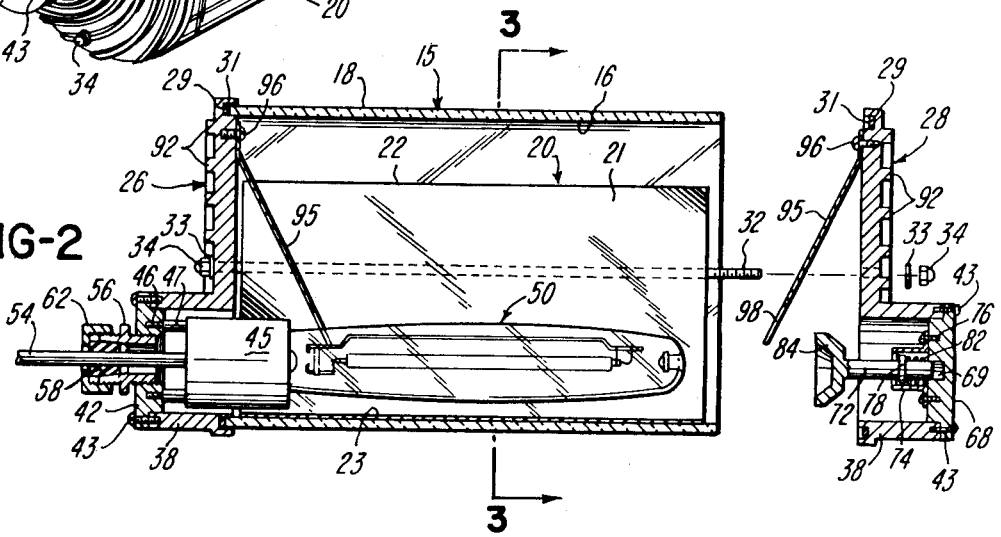
FIG. 2 is an axial section of the light fixture shown in FIG. 1 and with an end closure member shown in an exploded position.

As shown in FIG. 2, the axial length of the reflector sheet 20 is slightly less than the axial length of the tube 15, and the opposite end portions of the tube 15 receive a corresponding set of end closure members 26 and 28 which are preferably cast from aluminum. Each of the end closure members 26 and 28 includes an annular groove 29 which receives the corresponding end portion of the tube 15 and which confines an annular resilient rubber-like gasket 31 for engaging the corresponding end surface of the tube 15.

A pair of parallel spaced tie bolts 32 extend axially within the tube 15 between the reflector sheet 20 and the inner surface 16 of the tube and are disposed in diametrically opposite positions within the tube 15. The opposite end portions of each tie rod 32 are threaded and extend through corresponding holes within the end closure members 26 and 28, and each end portion receives a washer 33 and a cap-nut 34. When the nuts 34 are tightened, the end closure members 26 and 28 are drawn towards the ends of the tube 15 in order to compress and deform the gaskets 31 and to form a fluid-tight seal between the tube 15 and each end closure member.

Each of the end closure members 26 and 28 includes an outwardly projecting hollow hub portion 38 which is offset or positioned eccentrically relative to the axis of the tube 15. The tubular hub portion 38 of the end closure member 26 has an outer end which is closed by a circular plug-like end wall 42 secured by a set of screws 43.

A porcelain lamp socket 45 is supported within the tubular portion 38 of the end closure member 26 by a set of screws 46 which extend through corresponding spacer tubes 47. The lamp socket 45 receives the threaded base of an elongated lamp element 50 which may be of the sodium high vapor pressure type such as the lamp element marketed by the General Electric Company under the trademark "Lucalox." The lamp element 50 may also be of other types such as quartz-iodine or xenon lamp.

As shown in FIG. 3, the axis of the lamp element 50 is substantially coincedent or common with the axis of the tubular hub portions 38 of the end closure members 26 and 28 and is also substantially coincedent or common with the focal axis 52 of the curved reflector sheet 20. Electrical power is supplied through the lamp socket 45 to the lamp element 50 by a power cord 54 which is connected to a suitable transformer or ballast (not shown). The cord 54 extends through a tubular fitting 56 threaded into a center opening within the end wall 42 of the tubular hub portion 38. The fitting 56 has a frusto-conical internal end surface which receives a mating surface on a resilient annular sealing member 58. The sealing member 58 is retained by an annular cap 62 which is threadably connected to the fitting 56. Thus when the cap 62 is tightened, the sealing member 58 is compressed firmly between the outer surface of the power supply cord 54 and the inner surface of the fitting 56 to form a positive fluid-tight seal.

The tubular or hollow hub portion 38 of the opposite enclosure cap or member 28 includes a removable outer end wall 68 which is also secured by a set of screws 43. The end wall 68 includes a centrally located blind cylindrical bore 69 which slidably receives one end portion of a cylindrical aluminum rod 72. An intermediate portion of the rod 72 is supported by a cup-shaped sheet metal housing 74 having a bottom flange portion secured to the end wall 68 by a set of screws 76. The housing 74 surrounds an outwardly projecting circumferential flange 78 formed on the rod 72 and encloses a commpression coil spring 82 which extends between the flange 78 and the inner surface of the wall 68.

The outer end portion of the rod 72 supports an aluminum cup member 84 which is adapted to engage the outer corresponding end portion of the lamp element 50 when the end closure member 28 is mounted on the corresponding end of the tube 15. The spring loaded cup member 84 serves not only to position and support the outer end portion of the lamp element 50 but also cooperates to conduct heat from the lamp element 50 through the rod 72 and the housing 74 to the end wall 68 of the hub portion 38. The cup member 84 may be lined with a thin layer of asbestos material to provide a cushion support for the outer end of the lamp element 50.

As shown in FIGS. 1 and 2, both of the end closure members 26 and 28 are provided with a series of outwardly projecting arcuate fins or ribs 92 which extend concentrically with the corresponding hollow hub portion 38. The integral ribs 92 of the aluminum end closure members 26 and 28 cooperate to aid in dissipating heat which is generated when the lamp element 50 is energized.

The end closure members 26 and 28 also support a corresponding set of pair of end reflector sheets or members 95 which are formed from the same relatively stiff aluminum sheet material used to form the reflector sheet 20. Each of the end reflector members 95 includes an edge portion which is secured to the corresponding end closure member by a screw 96. The remaining or major portion of the reflector member projects in a cantilevered manner from the corresponding end closure member into the corresponding end portion of the tube 15 and curved reflector sheet 20. The inner end portion of each reflector sheet 95 has an arcuate recess 98 for receiving the corresponding end portion of the lamp element 50.

Figure 5:
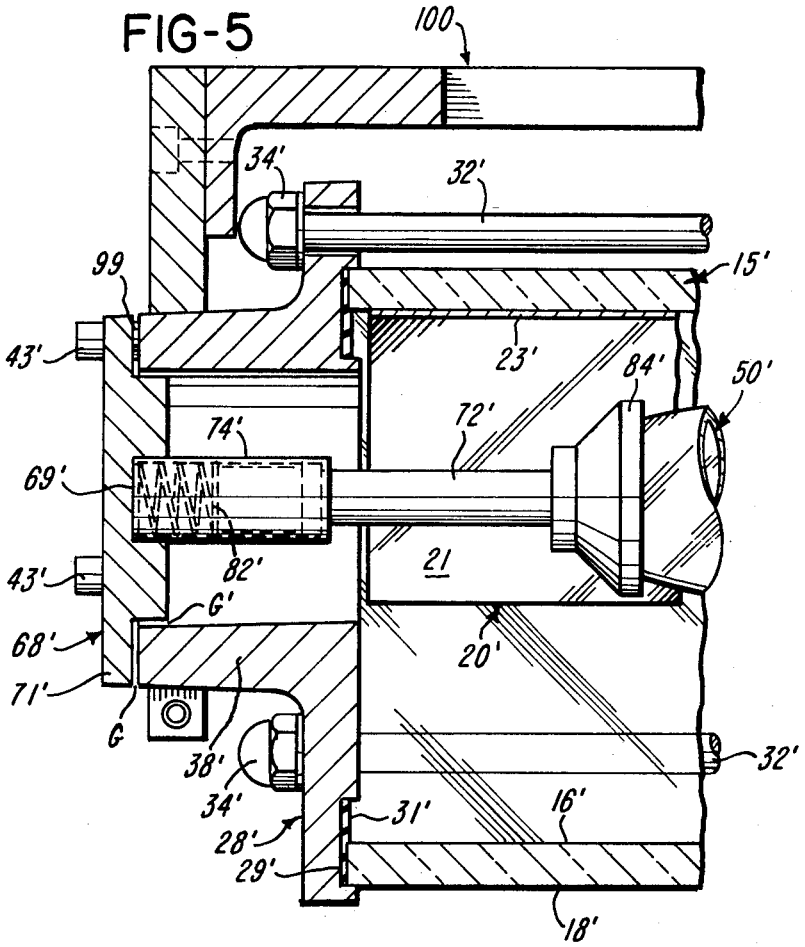
FIG. 5 is an enlarged fragmentary section of a modified light fixture constructed in accordance with the present invention.
Figure 6:
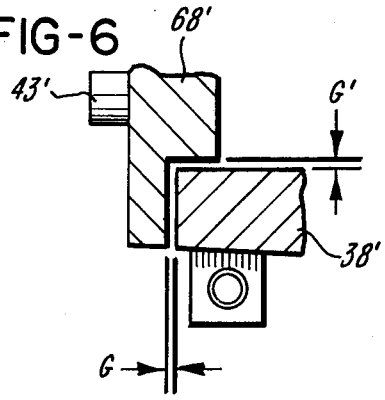
FIG. 6 is an enlargement of a portion of the fragmentary section shown in FIG. 5.

FIGS. 5 and 6 illustrate a light fixture which is constructed in accordance with the present invention and similar to the light fixture described above in connection with FIGS. 1–4. Since most of the components of the light fixture shown in FIGS. 5 and 6 are similar to the corresponding components of the light fixture shown in FIGS. 1–4, the same reference numbers are used to identify the corresponding components but followed by a prime mark.

The light fixture illustrated in FIG. 5 is ideally suited for use in an environment containing an inflammable or explosive gas or particles, and thus the cylindrical light transmitting glass tube 15' is preferably smaller in diameter and has a greater wall thickness than the tube 15 illustrated in FIGS. 1–3. The opposite end closure members 26' and 28' for the tube 15' are constructed similarly to the end closure members 26 and 28, but are tied or coupled together by three tie bolts or rods 32' which are uniformly spaced outboard of the glass tube 15'. This construction permits the cylindrical glass tube 15' to be constructed with a smaller diameter than the tube 15 so that the inner surface of the tube has a smaller area and may confine a gas at a higher explosive pressure without cracking.

The outer end wall or closure plugs 42' (not shown) and 68' are mounted on the opposite hub portions 38' and are secured by a set of screws 43' threaded into the corresponding hub portions 38'. Each of the closure members or plugs is constructed so that the flange portion 71' is spaced axially from the end surface of the corresponding hub portion 38' by means of spacer washers 99 mounted on the screws 43'. The spacer washers define an annular radial gap G which extends outwardly from an annular or cylindrical gap G' so that the gap (G-G') is L-shaped in axial cross-section, as shown in FIG. 6. Preferably, each of the gaps G and G' is within a range of 0.005 to 0.030 inch, and the combined gaps provide for releasing any gas which becomes pressurized within the tube 15', for example, due to an explosion of the gas.

The L-shaped annular gap also produces an abrupt change in the flow direction of the escaping pressurized gas and has been found highly effective in extinguishing any flames within the gas flowing through the gap. As a result, a light fixture constructed in accordance with the invention has been found to be highly desirable for use in an atmosphere or environment containing inflammable fumes or dust particles since the L-shaped configuration of the gap not only provides for a quick release of pressurized gas within the glass tube 15' so that the chance of breaking the tube is significantly reduced, but also prevents the escape of any flame for igniting the surrounding environment. The abrupt change of 90 degrees in the gas flow path through the gap also enables the gap to be formed substantially greater than 0.005 inch so that close machining tolerances are eliminated, and a larger gap provides for the quicker release of pressurized gas.

As also shown in FIG. 5, the hub portions 38' receive a U-shaped bracket 100, as shown in above mentioned U.S. Pat. No. 4,138,713, for supporting the light fixture in a manner which enables the light fixture to be conveniently adjusted.

While the form of light fixture herein described in connection with FIGS. 5 and 6 constitutes a preferred embodiment of the invention, it is to be understood that the invention is not limited to this precise form of light fixture, and that changes may be made therein without departing from the scope and spirit of the invention as defined in the appended claims.

The invention having thus been described, the following is claimed:

1. A light fixture adapted for use in an explosive environment containing flammable gases or particles, comprising an elongated light transmitting tube having opposite end portions, a set of end closure members mounted on said end portions of said tube, reflector means disposed within said tube and having a light reflecting surface, means located on one of said end closure members and supporting a lamp element within said tube, at least one of said end closure members including means defining a gap providing for the release of pressurized gas within said tube, and said gap defining means forming a path which abruptly changes the direction of the gas flowing through said gap for extinguishing any flame within the gas.

2. A light fixture as defined in claim 1 wherein said end closure member including said means defining said gap, comprise an annular hub portion having an end surface, a cap member spaced from said end surface and defining said gap, and means securing said cap member to said hub member.

3. A light fixture as defined in claim 2 wherein said cap member includes a portion projecting into said hub member and defining therewith a generally axially extending annular gap, and said cap member includes a flange portion overlying said end surface and defining therewith a generally radially extending annular gap extending outwardly from said axially extending gap.

4. A light fixture as defined in claim 3 wherein said axially extending annular gap and said radially extending annular gap are greater than 0.005 inch.

5. A light fixture as defined in claim 2 wherein said cap member supports a heat conducting member having means engaging said lamp element.

6. A light fixture as defined in claim 1 wherein said gap comprises an annular gap greater than 0.005 inch and is defined by mating inner and outer corner surfaces.

7. A light fixture as defined in claim 1 wherein said gap is defined between the end portion of a cylindrical hub member and a shouldered circular cap member mounted on said hub member in spaced relation.

8. A light fixture adapted for use in an environment of flammable gases or materials, comprising metal body means supporting a light transmitting member and cooperating therewith to define an enclosed chamber, reflector means disposed within said chamber and having a light refecting surface, a lamp element spaced within said chamber generally between said light transmitting member and said light reflecting surface, said body means defining a gap providing for the release of pressurized gas from said chamber, and said gap forming a path which abruptly changes the direction of the gas flowing through said gap for extinguishing any flame within the gas.

9. A light fixture as defined in claim 8 wherein said gap has an L-shaped cross-sectional configuration.

10. A light fixture as defined in claim 8 wherein said gap is substantially greater than 0.005 inch.

11. A light fixture as defined in claim 8 wherein said gap is annular and includes an axially extending portion connecting with a radially outwardly extending portion.

* * * * *